US008562420B2

(12) United States Patent
Roukis

(10) Patent No.: US 8,562,420 B2
(45) **Date of Patent: *Oct. 22, 2013**

(54) GAMING SYSTEM AND A METHOD OF GAMING

(75) Inventor: George Roukis, Miranda (AU)

(73) Assignee: Aristocrat Technologies Australia Pty Limited (AU)

( * ) Notice: Subject to any disclaimer, the term of this patent is extended or adjusted under 35 U.S.C. 154(b) by 0 days.

This patent is subject to a terminal disclaimer.

(21) Appl. No.: 13/528,315

(22) Filed: Jun. 20, 2012
(Under 37 CFR 1.47)

(65) Prior Publication Data

US 2012/0329546 A1 Dec. 27, 2012

Related U.S. Application Data

(63) Continuation of application No. 12/238,059, filed on Sep. 25, 2008, now Pat. No. 8,226,466.

(30) Foreign Application Priority Data

Sep. 26, 2007 (AU) ..... 2007905264

(51) Int. Cl.
*G07F 17/32* (2006.01)

(52) U.S. Cl.
USPC ..... 463/20; 463/16; 463/25

(58) Field of Classification Search
USPC ..... 463/16, 20, 25
See application file for complete search history.

(56) References Cited

U.S. PATENT DOCUMENTS

| | | | | |
|---|---|---|---|---|
| 8,226,466 | B2 * | 7/2012 | Roukis | 463/20 |
| 2006/0084494 | A1 * | 4/2006 | Belger et al. | 463/20 |

* cited by examiner

*Primary Examiner* — Omkar Deodhar
(74) *Attorney, Agent, or Firm* — McAndrews, Held & Malloy, Ltd.

(57) ABSTRACT

A method of gaming comprising: (a) selecting a plurality of symbols from a source symbol set to form a selected symbol set for display at a plurality of display positions, the source symbol set comprising at least one removable symbol and at least one designated symbol different to each removable symbol; and if a removal condition is met, the removal condition including at least that the selected symbol set includes at least one designated symbol within the display positions; (b) removing at least one removable symbol from the source symbol set from which it was selected to form a modified source symbol set; (c) selecting at least one symbol from the modified source symbol set to form a modified selected symbol set; and (d) determining whether to make an award based on the modified selected symbol set.

74 Claims, 6 Drawing Sheets

GAMING SYSTEM AND A METHOD OF GAMING

RELATED APPLICATIONS

This application is a continuation of U.S. patent application Ser. No. 12/238,059, having a filing date of Sep. 25, 2008 which claims priority to Australian Provisional Patent Application No. 2007905264, having a filing date of Sep. 26, 2007, which is incorporated herein by reference in its entirety.

FEDERALLY SPONSORED RESEARCH OR DEVELOPMENT

[Not Applicable]

MICROFICHE/COPYRIGHT REFERENCE

[Not Applicable]

BACKGROUND OF THE INVENTION

The present invention relates to a gaming system, a method of gaming, a game controller and computer program code.

It is known to provide a gaming system which comprises a game controller arranged to randomly display several symbols from a predetermined set of symbols and to determine a game outcome such as a game win based on the displayed symbols. Such gaming systems may commonly be implemented as a video slot machine wherein selected symbols are displayed as a plurality of virtual reels on a video display.

While such gaming systems provide users with enjoyment, a need exists for alternative gaming systems in order to maintain or increase player enjoyment.

BRIEF SUMMARY OF THE INVENTION

In a first aspect, the invention provides a method of gaming comprising:

(a) selecting a plurality of symbols from a source symbol set to form a selected symbol set for display at a plurality of display positions, the source symbol set comprising at least one removable symbol and at least one designated symbol different to each removable symbol; and if a removal condition is met, the removal condition including at least that the selected symbol set includes at least one designated symbol within the display positions;

(b) removing at least one removable symbol from the source symbol set from which it was selected to form a modified source symbol set;

(c) selecting at least one symbol from the modified source symbol set to form a modified selected symbol set; and (d) determining whether to make an award based on the modified selected symbol set.

In an embodiment, the source symbol set comprises a plurality of symbol sets at least one of the symbol sets comprising at least one removable symbol and at least one of the symbols sets comprising at least one designated symbol, and the method comprises selecting at least one symbol from each of the plurality of symbol sets, and if a removable symbol is to be removed, removing the at least one removable symbol from at least the symbol set from which it was selected to form a modified plurality of symbol sets constituting the modified source symbol set and selecting at least one symbol from each of the modified plurality of symbol sets to form the modified selected symbol set.

In an embodiment, the removal condition is solely that the designated symbol is one of the selected symbols.

In an embodiment, the removal condition also requires that the designated symbol is within a designated number of display positions from the removable symbol.

In an embodiment, the designated number of display positions are neighbouring display positions.

In an embodiment, the method comprises determining whether to make an award after step (a).

In an embodiment, the method comprises repeating steps (b) to (d) at least once.

In an embodiment, the method comprises repeating steps (b) to (d) until an end condition is met.

In an embodiment, the end condition is that steps (b) to (d) are repeated a number (N) of times.

In an embodiment, the end condition is that a number (M) of removable symbols have been removed.

In an embodiment, the game is a spinning reel game and each symbol set corresponds to a reel.

In an embodiment, each designated symbol belongs to at least one reel that has a pair of neighbouring reels.

In an embodiment, there are five reels and the designated 20 symbols belong to reels two and four.

In an embodiment, the removable symbols are from a first class of symbols.

In an embodiment, the first class of symbols are royal symbols.

In an embodiment, the method comprises removing all removable symbols of the same type from all of the symbol sets.

In an embodiment, the method comprises removing all removable symbols of the same type from the symbol set to which a symbol to be removed belongs.

In an embodiment, the method comprises removing a single symbol from the source symbol set.

In an embodiment, the method comprises removing no more than one symbol from each symbol set.

In an embodiment, the method comprises replacing each removed symbol with a non-removable symbol.

In a second aspect, the invention provides a game controller for a gaming system, the game controller arranged to:

a) select a plurality of symbols from a source symbol set to form a selected symbol set for display at a plurality of display positions, the source symbol set comprising at least one removable symbol and at least one designated symbol different to each removable symbol; and if a removal condition is met, the removal condition including at least that the selected symbol set includes at least one designated symbol within the display positions;

(b) remove at least one removable symbol from the source symbol set from which it was selected to form a modified source symbol set;

(c) select at least one symbol from the modified source symbol set to form a modified selected symbol set; and (d) determine whether to make an award based on the modified selected symbol set.

In an embodiment, the game controller comprises a symbol 30 removal module arranged to remove removable symbols from the symbol sets.

In an embodiment, the symbol removal module determines whether the removal condition is met.

In an embodiment, the game controller comprises a symbol selector for selecting symbols.

In an embodiment, the game controller comprises a symbol replacer for replacing removed symbols.

In an embodiment, the game controller is implemented by a processor executing program code stored in a memory.

In an embodiment, the memory stores symbol data specifying the source symbol set, the modified source symbol set, lo removable symbols and designated symbols.

In an embodiment, the source symbol set comprises a plurality of symbol sets at least one of the symbol sets comprising at least one removable symbol and at least one of the symbols sets comprising at least one designated symbol, and the game controller is arranged to select at least one symbol from each of the plurality of symbol sets, and if a removable symbol is to be removed, remove the at least one removable symbol from at least the symbol set from which it was selected to form a modified plurality of symbol sets constituting the modified source symbol set and select at least one symbol from each of the modified plurality of symbol sets to form the modified selected symbol set.

In an embodiment, the removal condition is solely that the designated symbol is one of the selected symbols.

In an embodiment, the removal condition also requires that 30 the designated symbol is within a designated number of display positions from the removable symbol.

In an embodiment, the designated number of display positions are neighbouring display positions.

In an embodiment, the game controller is further arranged to determine whether to make an award after the initial selection of symbols from the source symbol set.

In an embodiment, the game controller is further arranged to, if a removal condition is met in respect of the modified selected symbol set, the removal condition including at least that the selected symbol set includes at least one designated symbol within the display positions;

(b) remove at least one removable symbol from 10 the modified source symbol set from which it was selected to form a further modified source symbol set;

(c) select at least one symbol from the modified source symbol set to form a further modified selected symbol set; and (d) determine whether to make an award based on the further modified selected symbol set.

In an embodiment, the game controller is arranged to repeatable determine whether each modified symbol set contains a removable symbol until an end condition is met.

In an embodiment, the end condition is that a determination as to whether a removable symbol is in the selected symbol set is carried out a number (N) of times.

In an embodiment, the end condition is that a number (M) of removable symbols have been removed.

In an embodiment, the game is a spinning reel game and 30 each symbol set corresponds to a reel.

In an embodiment, each designated symbol belongs to at least one reel that has a pair of neighbouring reels.

In an embodiment, there are five reels and the designated symbols belong to reels two and four.

In an embodiment, the removable symbols are from a first class of symbols.

In an embodiment, the first class of symbols are royal symbols.

In an embodiment, the game controller is arranged to remove all removable symbols of the same type from all of the symbol sets.

In an embodiment, the game controller is arranged to remove all removable symbols of the same type from the symbol set to which a symbol to be removed belongs.

In an embodiment, the game controller is arranged to remove a single symbol from the source symbol set.

In an embodiment, the game controller is arranged to remove no more than one symbol from each symbol set.

In an embodiment, the game controller is further arranged to replace each removed symbol with a non-removable symbol.

In a third aspect, the invention provides a gaming system comprising:

a display; and game controller arranged to:

a) select a plurality of symbols from a source symbol set to form a selected symbol set for display at a plurality of display positions on the display, the source symbol set comprising at least one removable symbol and at least one designated symbol different to each removable symbol; and if a removal condition is met, the removal condition including at least that the selected symbol set includes at least one designated symbol within the display positions;

(b) remove at least one removable symbol from the source symbol set from which it was selected to form a modified source symbol set;

(c) select at least one symbol from the modified source symbol set to form a modified selected symbol set; and (d) determine whether to make an award based on the modified selected symbol set.

In an embodiment, the gaming system comprises a game play mechanism operable by a player to initiate play of the gaming system.

In an embodiment, the game controller comprises a symbol removal module arranged to remove removable symbols from the symbol sets.

In an embodiment, the symbol removal module determines 20 whether the removal condition is met.

In an embodiment, the game controller comprises a symbol selector for selecting symbols.

In an embodiment, the game controller comprises a symbol replacer for replacing removed symbols.

In an embodiment, the game controller is implemented by a processor executing program code stored in a memory.

In an embodiment, the memory stores symbol data specifying the source symbol set, the modified source symbol set, removable symbols and designated symbols.

In an embodiment, the source symbol set comprises a plurality of symbol sets at least one of the symbol sets comprising at least one removable symbol and at least one of the symbols sets comprising at least one designated symbol, and the game controller is arranged to select at least one symbol from each of the plurality of symbol sets, and if a removable symbol is to be removed, remove the at least one removable symbol from at least the symbol set from which it was selected to form a modified plurality of symbol sets constituting the modified source symbol set and select at least one symbol from each of the modified plurality of symbol sets to form the modified selected symbol set.

In an embodiment, the removal condition is solely that the designated symbol is one of the selected symbols.

In an embodiment, the removal condition also requires that the designated symbol is within a designated number of display positions from the removable symbol.

In an embodiment, the designated number of display 20 positions are neighbouring display positions.

In an embodiment, the game controller is further arranged to determine whether to make an award after the initial selection of symbols from the source symbol set.

In an embodiment, the game controller is further arranged to, if a removal condition is met in respect of the modified selected symbol set, the removal condition including at least that the selected symbol set includes at least one designated symbol within the display positions;

(b) remove at least one removable symbol from the modified source symbol set from which it was selected to form a further modified source symbol set;

(c) select at least one symbol from the modified source symbol set to form a further modified selected symbol set; and (d) determine whether to make an award based on the further modified selected symbol set.

In an embodiment, the gaming system as claimed in claim is arranged to repeatably determine whether each modified symbol set contains a removable symbol until an end condition is met.

In an embodiment, the end condition is that a determination as to whether a removable symbol is in the selected symbol set is carried out a number (N) of times.

In an embodiment, the end condition is that a number (M) of removable symbols have been removed.

In an embodiment, the game is a spinning reel game and each symbol set corresponds to a reel.

In an embodiment, each designated symbol belongs to at least one reel that has a pair of neighbouring reels.

In an embodiment, there are five reels and the designated symbols belong to reels two and four.

In an embodiment, the removable symbols are from a first class of symbols.

In an embodiment, the first class of symbols are royal symbols.

In an embodiment, the game controller is arranged to remove all removable symbols of the same type from all of the symbol sets.

In an embodiment, the game controller is arranged to remove all removable symbols of the same type from the symbol set to which a symbol to be removed belongs.

In an embodiment, the game controller is arranged to remove a single symbol from the source symbol set.

In an embodiment, the game controller is arranged to remove no more than one symbol from each symbol set.

In an embodiment, the game controller is further arranged to replace each removed symbol with a non-removable lo symbol.

In a fourth aspect, the invention provides computer program code which when executed implements the above method.

In a fifth aspect, the invention provides a computer readable storage medium comprising the program code.

In a sixth aspect, the invention provides a data signal 20 comprising the program code.

In a seventh aspect, the invention extends to transmitting the program code.

DETAILED DESCRIPTION OF THE INVENTION

The embodiment provides a gaming system having a game controller which implements a game where symbols are removed from reels for subsequent spins if they appear on the display in a designated relationship to a designated symbol. The gaming system may be provided in a number of different forms.

In a first form, a stand alone gaming machine is provided wherein all or most components required for implementing the game are present in a player operable gaming machine.

In a second form, a distributed architecture is provided wherein some of the components required for implementing the game are present in a player operable gaming machine and some of the components required for implementing the game are located remotely relative to the gaming machine. For example, a "thick client" architecture may be used wherein part of the game is executed on a player operable gaming machine and part of the game is executed remotely, such as by a gaming server; or a "thin client" architecture may be used wherein most of the game is executed remotely such as by a gaming server and a player operable gaming machine is used only to display audible and/or visible gaming information to the player and receive gaming inputs from the player.

However, it will be understood that other arrangements are envisaged. For example, an architecture may be provided wherein a gaming machine is networked to a gaming server and the respective functions of the gaming machine and the gaming server are selectively modifiable. For example, the gaming system may operate in stand alone gaming machine mode, "thick client" mode or "thin client" mode depending on the game being played, operating conditions, and so on. Other variations will be apparent to persons skilled in the art.

Figure 1:
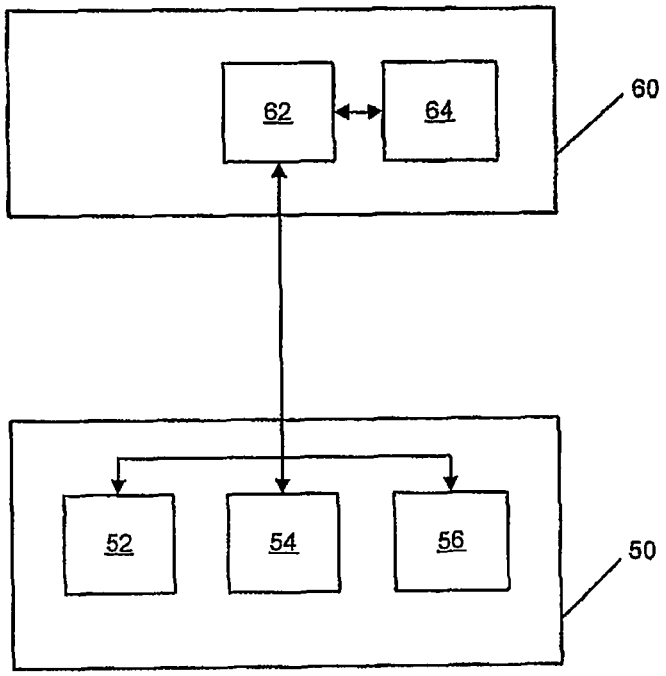
FIG. 1 is a block diagram of the core components of a gaming system.

Irrespective of the form, the gaming system has several core components. At the broadest level, the core components are a player interface 50 and a game controller 60 as illustrated in FIG. 1. The player interface is arranged to enable manual interaction between a player and the gaming system and for this purpose includes the input/output components required for the player to enter instructions and play the game.

Components of the player interface may vary from embodiment to embodiment but will typically include a credit mechanism 52 to enable a player to input credits and receive payouts, one or more displays 54 and a game play mechanism 56 that enables a player to input game play instructions.

The game controller 60 is in data communication with the player interface and typically includes a processor 62 that processes the game play instructions in accordance with game play rules and outputs game play outcomes to the display. Typically, the game play instructions are stored as program code in a memory 64 but can also be hardwired. Herein the term "processor" is used to refer generically to any device that can process game play instructions in accordance with game play rules and may include: a microprocessor, microcontroller, programmable logic device or other computational device, a general purpose computer (e.g. a PC) or a server.

Figure 2:
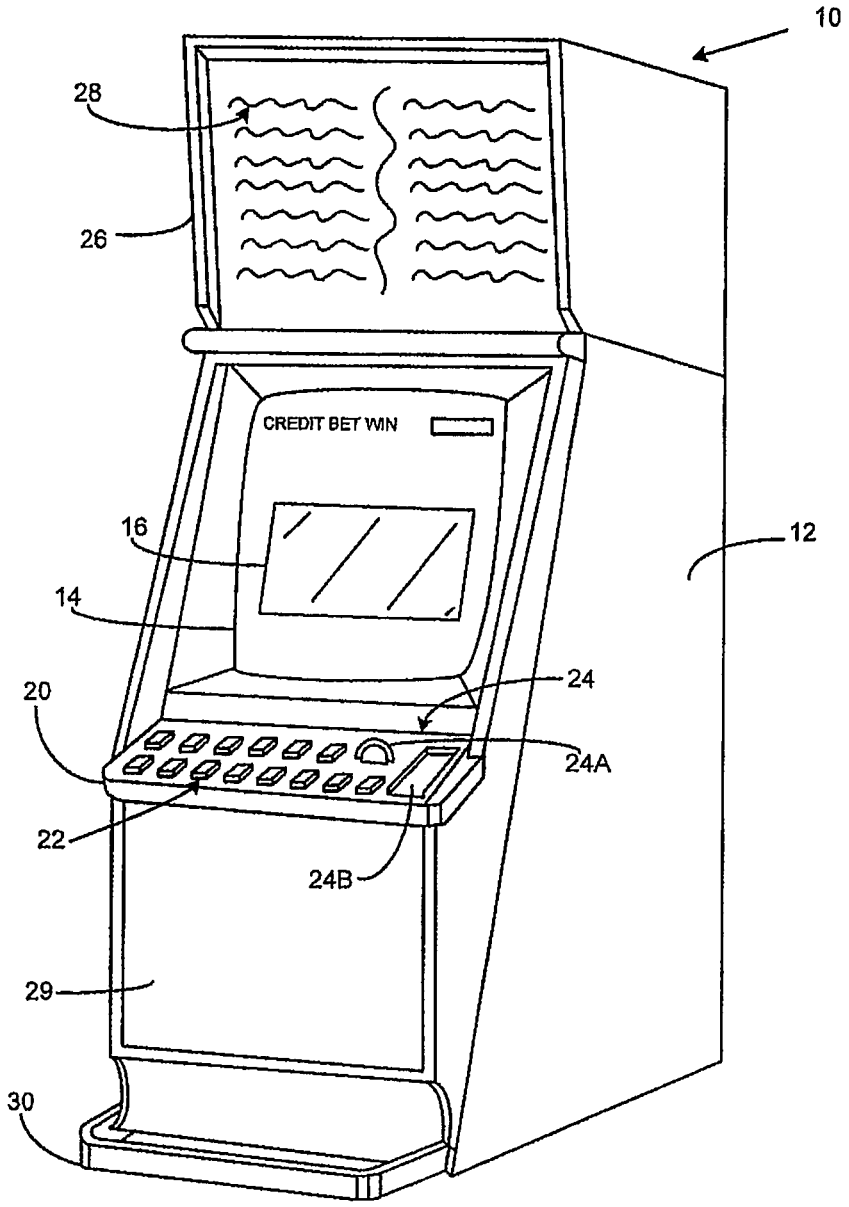
FIG. 2 is a perspective view of a gaming machine.

A gaming system in the form of a stand alone gaming machine 10 is illustrated in FIG. 2. The gaming machine 10 includes a console 12 having a display 14 on which is displayed representations of a game 16 that can be played by a player. A mid-trim 20 of the gaming machine 10 houses a bank of buttons 22 for enabling a player to interact with the gaming machine, in particular during game play. The mid-trim 20 also houses a credit input mechanism 24 which in this example includes a coin input chute 24A and a bill collector 24B. Other credit input mechanisms may also be employed, for example, a card reader for reading a smart card, debit card or credit card. A player marketing module may be provided having a reading device may also be provided for the purpose of reading a player tracking device, for example as part of a loyalty program. The player tracking device may be in the form of a card, flash drive or any other portable storage medium capable of being read by the reading device.

A top box 26 may carry artwork 28, including for example pay tables and details of bonus awards and other information or images relating to the game. Further artwork and/or information may be provided on a front panel 29 of the console 12. A coin tray 30 is mounted beneath the front panel 29 for dispensing cash payouts from the gaming machine 10.

The display 14 shown in FIG. 2 is in the form of a video display unit, particularly a cathode ray tube screen device. Alternatively, the display 14 may be a liquid crystal display, plasma screen, any other suitable video display unit, or the visible portion of an electromechanical device. The top box 26 may also include a display, for example a video display unit, which may be of the same type as the display 14, or of a different type.

Figure 3:
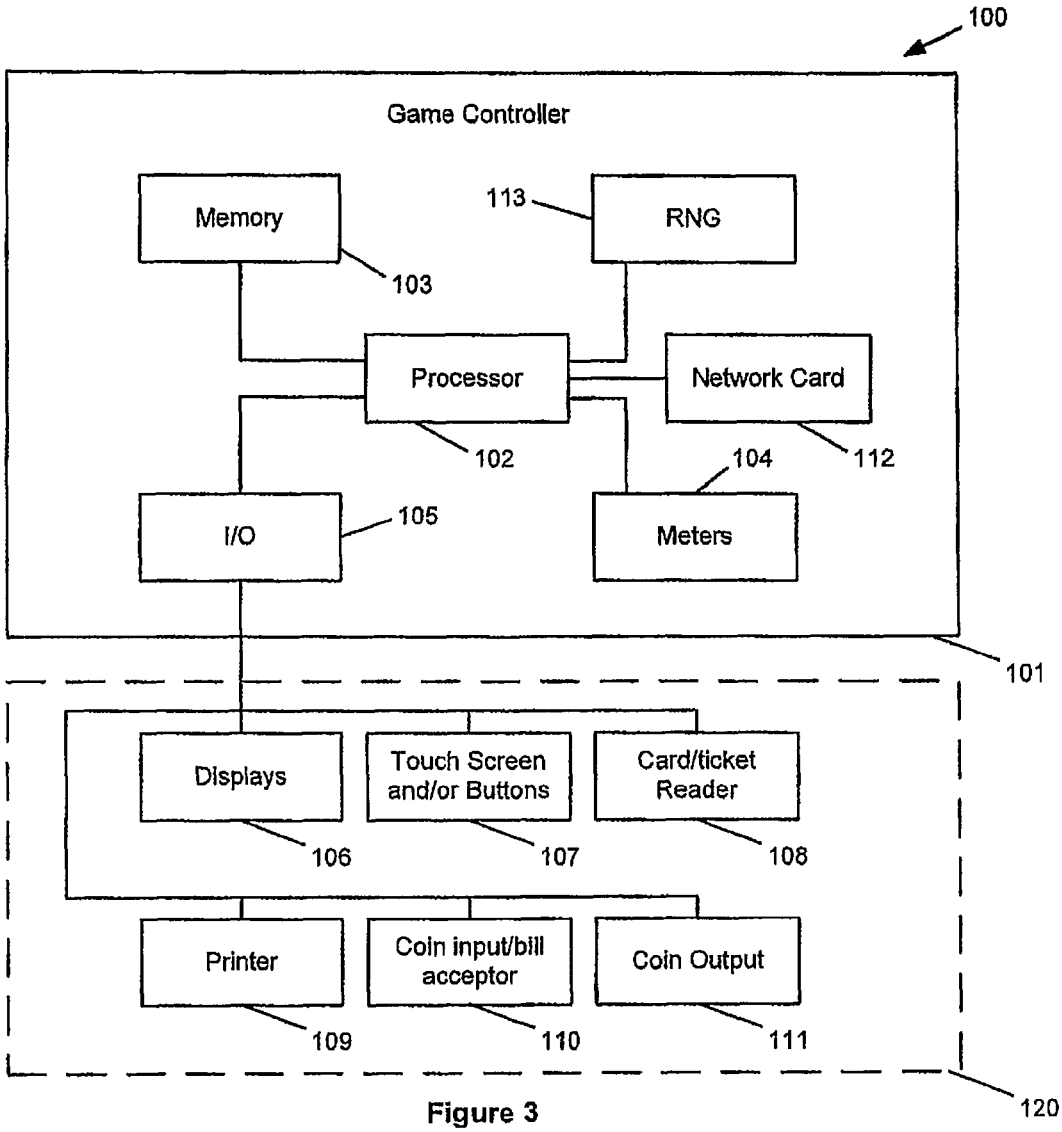
FIG. 3 is a block diagram of the functional components of a gaming machine.

FIG. 3 shows a block diagram of operative components of a typical gaming machine which may be the same as or different to the gaming machine of FIG. 2.

The gaming machine 100 includes a game controller 101 having a processor 102. Instructions and data to control operation of the processor 102 are stored in a memory 103, which is in data communication with the processor 102. Typically, the gaming machine 100 will include both volatile and non-volatile memory and more than one of each type of memory, with such memories being collectively represented by the memory 103.

The gaming machine has hardware meters 104 for purposes including ensuring regulatory compliance and monitoring player credit, an input/output (I/O) interface 105 for communicating with peripheral devices of the gaming machine 100. The input/output interface 105 and/or the peripheral devices may be intelligent devices with their own memory for storing associated instructions and data for use with the input/output interface or the peripheral devices. A random number generator module 113 generates random numbers for use by the processor 102. Persons skilled in the art will appreciate that the reference to random numbers includes pseudo-random numbers.

In the example shown in FIG. 3, a player interface 120 includes peripheral devices that communicate with the game controller 101 including one or more displays 106, a touch screen 107, a card and/or ticket reader 108, a printer 109, a bill acceptor and/or coin input mechanism 110 and a coin output mechanism 111. Additional hardware may be included as part of the gaming machine 100, or hardware may be omitted as required for the specific implementation.

In addition, the gaming machine 100 may include a communications interface, for example a network card 112. The network card may, for example, send status information, accounting information or other information to a central controller, server or database and receive data or commands from the central controller, server or database.

Figure 4:
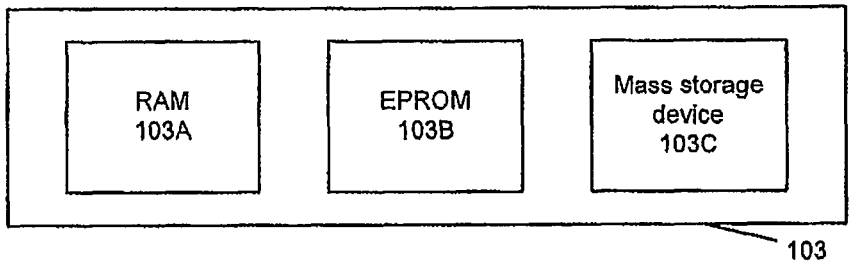
FIG. 4 is a block diagram representing the structure of a memory.

FIG. 4 shows a block diagram of the main components of an exemplary memory 103. The memory 103 includes RAM 103A, EPROM 103B and a mass storage device 103C. The RAM 103A typically temporarily holds program files for execution by the processor 102 and related data. The EPROM 1036 may be a boot ROM device and/or may contain some system or game related code. The mass storage device 103C is typically used to store game programs, the integrity of which may be verified and/or authenticated by the processor 102 using protected code from the EPROM 103B or elsewhere.

It is also possible for the operative components of the gaming machine 100 to be distributed, for example input/output devices 106,107,108,109,110,111 to be provided remotely from the game controller 101.

Figure 5:
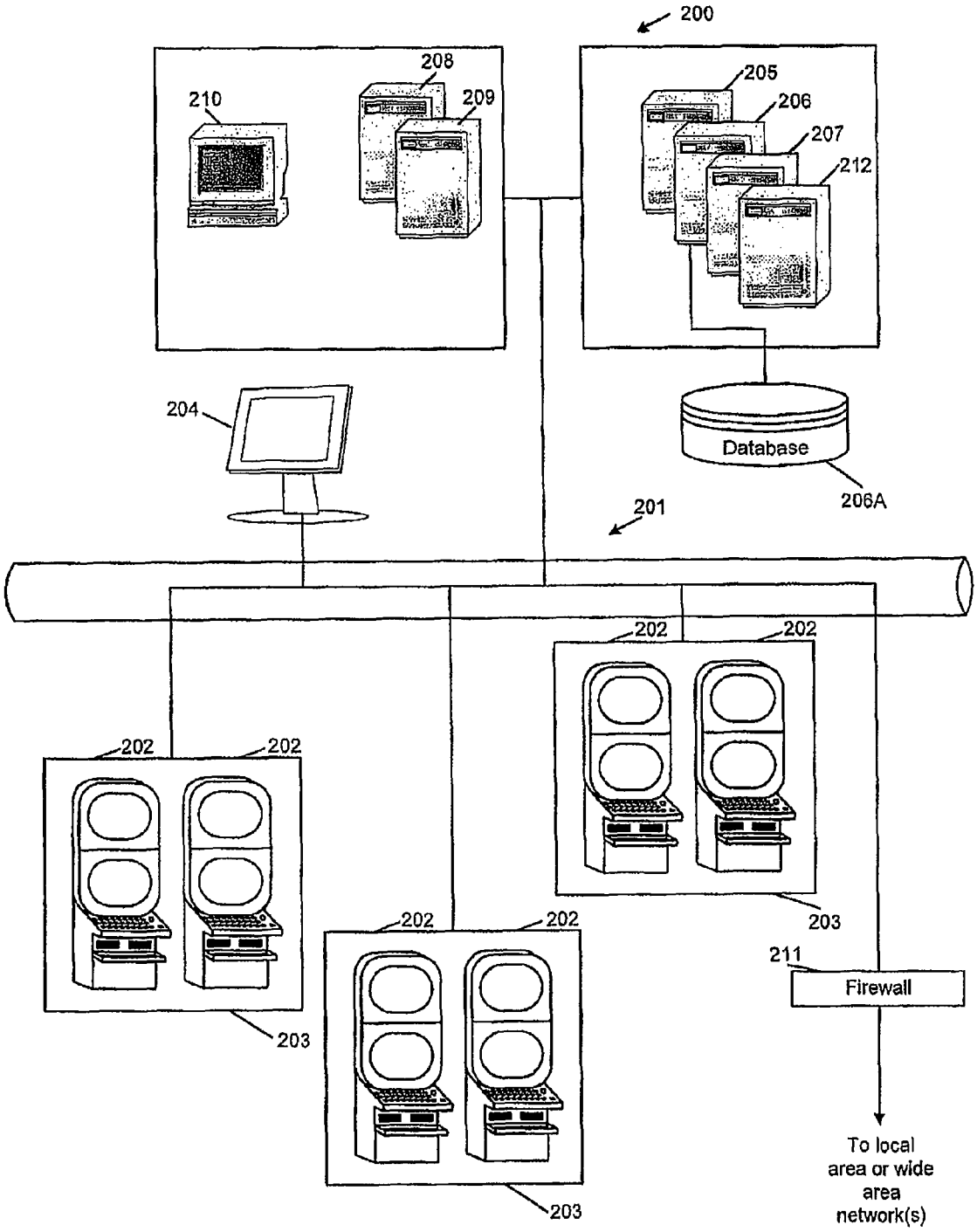
FIG. 5 is a diagram schematic of a networked gaming system.

FIG. 5 shows a gaming system 200 in accordance with an alternative embodiment. The gaming system 200 includes a network 201, which for example may be an Ethernet network. Gaming machines 202, shown arranged in three banks 203 of two gaming machines 202 in FIG. 5, are connected to the network 201. The gaming machines 202 provide a player operable interface and may be the same as the gaming machines 10,100 shown in FIGS. 2 and 3, or may have simplified functionality depending on the requirements for implementing game play. While banks 203 of two gaming machines are illustrated in FIG. 5, banks of one, three or more gaming machines are also envisaged.

One or more displays 204 may also be connected to the network 201. The displays 204 may, for example, be associated with one or more banks 203 of gaming machines. The displays 204 may be used to display representations associated with game play on the gaming machines 202, and/or used to display other representations, for example promotional or informational material.

In a thick client embodiment, game server 205 implements part of the game played by a player using a gaming machine 202 and the gaming machine 202 implements part of the game. With this embodiment, as both the game server and the gaming device implement part of the game, they collectively provide a game controller. A database management server 206 may manage storage of game programs and associated data for downloading or access by the gaming devices 202 in a database 206A. Typically, if the gaming system enables players to participate in a Jackpot game, a Jackpot server 207 will be provided to carry out the accounting in respect of the Jackpot game. A loyalty program server 212 may also be provided.

In a thin client embodiment, game server 205 implements most or all of the game played by a player using a gaming machine 202 and the gaming machine 202 essentially provides only the player interface. With this embodiment, the game server 205 provides the game controller. The gaming machine will receive player instructions, pass these to the game server which will process them and return game play outcomes to the gaming machine for display. In a thin client embodiment, the gaming machines could be computer terminals, e.g. PCs running software that provides a player interface operable using standard computer input and output components.

Servers are also typically provided to assist in the administration of the gaming network 200, including for example a gaming floor management server 208, and a licensing server 209 to monitor the use of licenses relating to particular games. An administrator terminal 210 is provided to allow an administrator to run the network 201 and the devices connected to the network.

The gaming network 200 may communicate with other gaming systems, other local networks, for example a corporate network, and/or a wide area network such as the Internet, for example through a firewall 211.

Persons skilled in the art will appreciate that in accordance with known techniques, functionality at the server side of the network may be distributed over a plurality of different computers. For example, elements may be run as a single "engine" on one server or a separate server may be provided. For example, the game server 205 could run a random generator engine. Alternatively, a separate random number generator server could be provided. Further, persons skilled in the art will appreciate that a plurality of games servers could be provided to run different games or a single game server may run a plurality of different games as required by the terminals.

The embodiment may be implemented in relation to a spinning reel type game. Gaming systems for implementing games that involve a display of spinning reels as part of the display of the outcome of a game have typically have a video display. However, persons skilled in the art will appreciate that the invention can be implemented in respect of other forms of games where symbols are selected from symbol sets.

In some implementations the game controllers of such gaming machines select symbols by employing a stop determining function that randomly determines the stop position for each reel. For example, if there are five reels, each having twenty symbols, the stop determining function might determine that the stop positions are positions: 3, 13, 7, 9 and 17. The spinning of the reels is then controlled so that each symbol comes to a stop in the same row, typically a predetermined row in a "window" visible to the player on the display that which corresponds to a player playing a single win line. When a reel stops, the symbols will be in one of a plurality of possible symbol positions for that reel relative to the stop position.

Spinning reel type games typically allow a player to select how many win lines of a plurality of win lines they will play in each game—i.e. a minimum of one win line up to the maximum number of win lines allowed by the game. Persons, skilled in the art, will appreciate that in other embodiments, the player may select a number of reels to play. Each win line is formed by a set of symbol positions consisting of one symbol position from each reel. That is, a predetermined symbol position of each reel is assigned to a win line. The symbol positions that constitute each of the win lines are usually advertised to the player by markings on the display or diagrams showing the symbol positions that correspond to each win line. A game outcome is determined based on the symbols on the win lines and a prize table that specifies awards. Games can be evaluated in other manners, for example, in other embodiments, players may play reels rather than lines.

Figure 6:
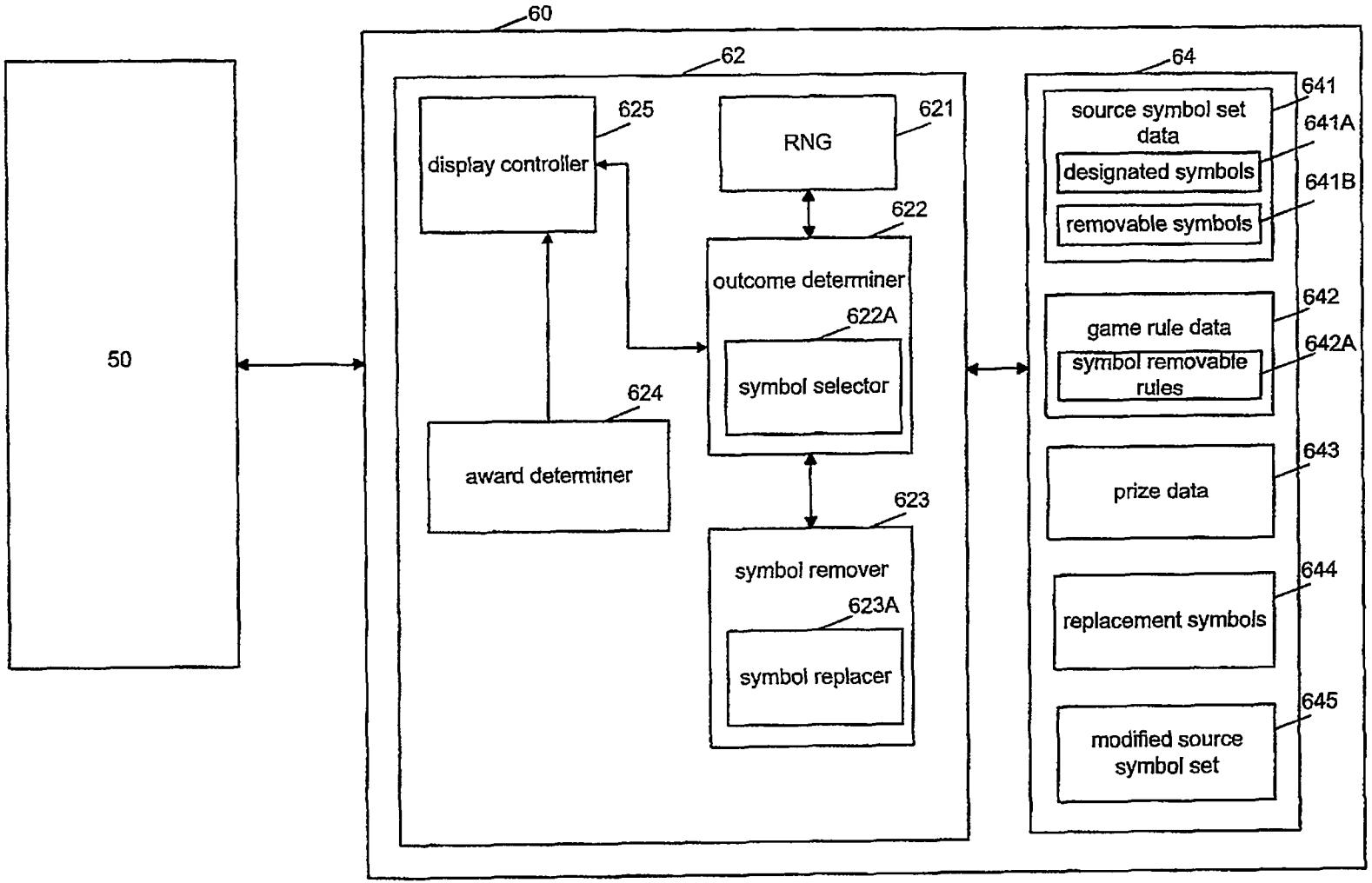
FIG. 6 is a further block diagram of the gaming system.
Figure 7:
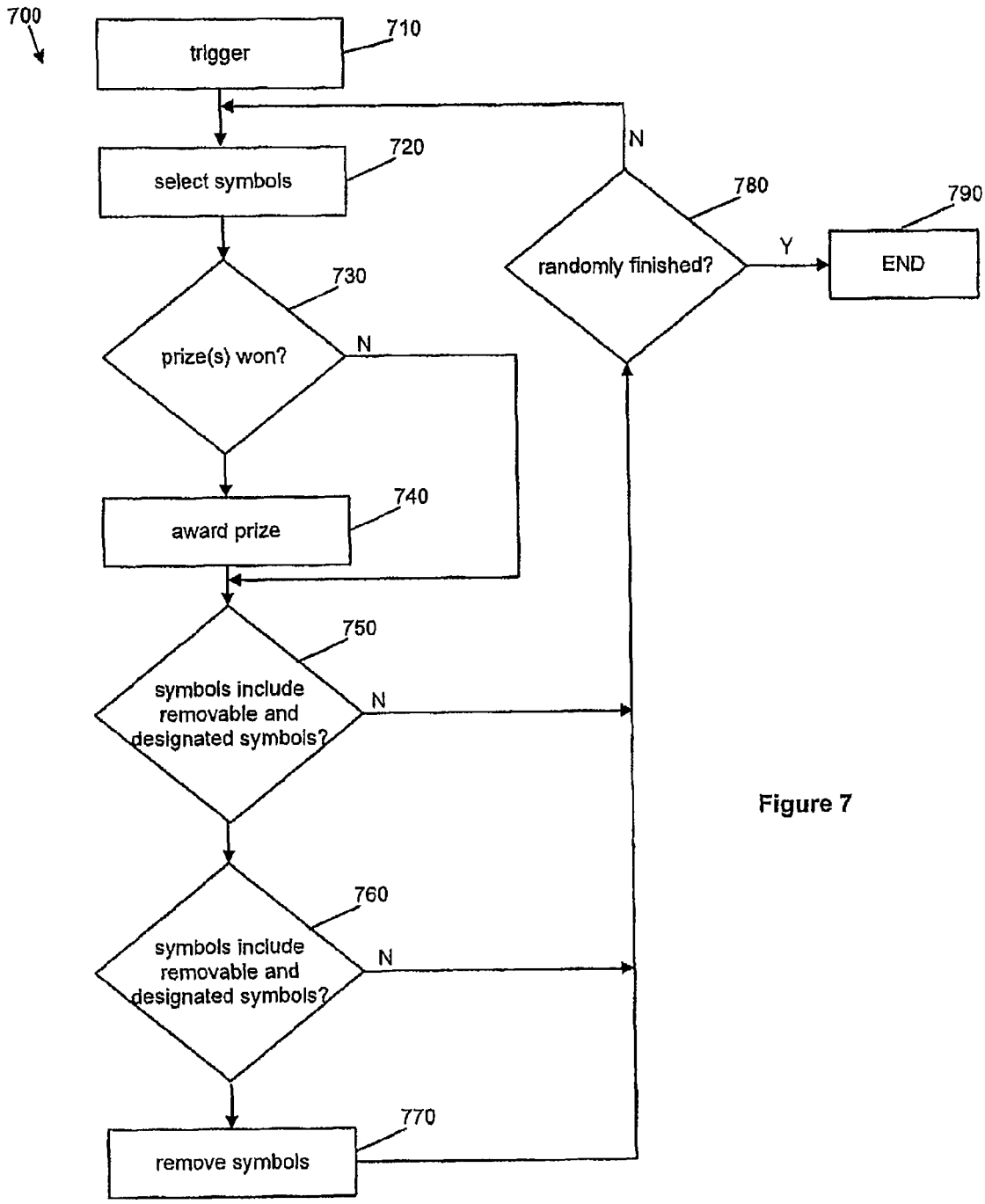
FIG. 7 is a flowchart of an embodiment.

The game controller 60 of the embodiment is shown in more detail in FIG. 6. It will apparent that the processor 62 implements a number of modules, for example random number generator module 621 by executing software routines stored as program code in memory 64. Persons skilled in the art will appreciate that not all modules need be implemented by processor 62. For example, the random number generator module 621 could be implemented by a separate circuit or by a random number generator server.

In the embodiment, the game is implemented as a special game. Special games can be any of the special games known in the art including:

- free games;
- free spins (where some of the reels are held and other reels spin);
- games purchased with a constraint, eg. where the bet is the same amount bet on the triggering game;
- games purchased without constraints; or
- a triggered feature which is stored and played at 20 a later time such as determined by the player or some other event.

Typically, the game controller 60 will implement the game after a trigger condition occurs. Trigger conditions are known in the art and accordingly are not described in detail however it will be appreciated that a trigger can be: a trigger symbol occurring on the reels; a trigger event received from a system or machine; a random trigger event; or a player purchased trigger.

Once the game is triggered, a symbol selector 622A of an outcome determiner 622 selects a set of symbols for display at a plurality of display positions on display 54 from a source symbol set data 641. As can be seen from FIG. 6, source symbol set data 641 also includes designated symbols 641A and removable symbols 641B. Typically the source symbol set is separated into a plurality of sets such that selection occurs from the plurality of sets. One or more sets may include a removable or a designated symbol depending on the implementation. In the embodiment each of these sets corresponds to a reel strip on a spinning reel machine.

Accordingly, the selected symbols are displayed by display controller 625 on the display 54 at a plurality of display positions. In the case where the sets of symbols correspond to reels, this involves a display of a portion of the reels corresponding to the selected symbols. The symbol sets may define a sequence in which the symbols are displayed as is the case with reels and hence the selection of symbols will be within this constraint.

An award determiner 624 determines whether an award is to be made based on the selected symbols. For example if the selected symbol, set defines a winning combination as specified by prize data 643.

The symbol remover 623 determines whether symbols are to be removed from the symbol sets in accordance with symbol removal rules 642A of game rule data 642. In the embodiment, symbols are removed if a symbol removal condition is met. The symbol removal condition includes at least that the selected symbol set includes a removable symbol and a designated symbol and advantageously that the removable symbol is in a designated relationship to a designated symbol, the designated relationship being specified by the removal rules 642A. In some embodiments there may be additional conditions, for example, symbols may not be removed the first time a designated symbol 641A is in a designated relationship or there may need to be a specific combination of designated symbols 641A before the removal of symbols occurs. Assuming that a symbol removal condition is met, the symbol remover 623 removes the symbol from the symbol set by forming a modified source symbol set 645 without the removed symbol or symbols as removed symbols data. Future selections are made from the modified symbol set 645 such that the removed symbols will not be used in subsequent selection and the modified symbol set may be modified subsequently if further symbols are removed. As described above, the modified source symbol set may include a plurality of sets of symbols.

Depending on the embodiment, it may be required for the mathematics of the game to replace the symbols. In this case the symbol replacer 623A replaces the removed symbol or symbols using replacement symbols 644. The outcome determiner 622 then begins a new game round by using the random number generator 621 and symbol selector 622A to select a further set of symbols from the modified source symbol set data 645. The outcome determiner 622 continues to repeat the process of removing and replacing symbols until an end condition is met. The end condition may be that a designated number of symbols have been removed, the designated number of game rounds have occurred etc.

The designated relationship can take a number of forms. In one example it may be that the symbol must appear within a designated number of display positions from the removable symbol, for example a neighbouring symbol.

The rules as to which symbols are removed can also vary for example all of the selected symbols may be removed, all of the removable symbols on a particular reel may be removed, only one symbol on each reel may be removed (for example by determining the closest designated symbol) or only one symbol on any reel may be removed. These arrangements are specified by the removal rule data 642A.

The replacement symbols can be any of the known symbols in game machines including the special symbols such as a wild, scatter or jackpot symbol or in deed can be a new symbol.

In the embodiment the symbols that are removed are royal symbols which traditionally have lower prizes but higher is frequency than "picture" symbols. However, a person skilled in the art will appreciate that various symbol combinations can be removed.

In the embodiment, the designated symbol is a wild symbol but a person a skilled in the art will appreciate that there can be a number of designated different designated symbols or a plurality of designated symbols.

It will be appreciated from the above, that removable symbols will typically form one class of symbols available within the symbol sets specified by symbol set data 641, in this case royal symbols, such that it is possible to remove a number of different types of symbols within the general class.

EXAMPLE

In the example, when a wild symbol appears it will "strike" at any neighbouring removable symbols which in this example are royal symbols. In this example, the wild symbol is only provided on reels 2 and 4 to limit the symbols that it can strike and it can strike up to 8 surrounding symbols. If a royal symbol is struck, all of these reels are removed from the selectable symbol set for the next free game. That way each free game has a single determining outcome.

The game may also be configured such as if the wild appears and strikes a picture symbol than a bonus prize may be awarded. A person skilled in the art will appreciate that as the royal symbols are removed the chances of performing winning symbol combinations will increase.

Further aspects of the method will be apparent from the above description of the gaming system. Persons skilled in the art will also appreciate that the method could be embodied in program code. The program code could be supplied in a number of ways, for example on a computer readable medium, such as a disc or a memory (for example, that could replace part of memory 103) or as a data signal (for example, by downloading it from a server).

Other variations would be apparent to persons skilled in the art and should be considered as falling within the scope of the invention described herein. In particular, features described above can be employed to form further embodiments.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

It is to be understood that, if any prior art publication is referred to herein, such reference does not constitute an admission that the publication forms a part of the common general knowledge in the art, in Australia or any other country.

The invention claimed is:

1. A method comprising:

(a) selecting a plurality of symbols from a source symbol set to form a selected symbol set for display at a plurality of display positions, the source symbol set comprising at least one removable symbol and at least one designated symbol different to each removable symbol; and in response to a removal condition being met, the removal condition including at least that the selected symbol set includes at least one designated symbol within the display positions;

(b) removing at least one removable symbol from the source symbol set from which it was selected to form a modified source symbol set;

(c) selecting at least one symbol from the modified source symbol set to form a modified selected symbol set; and (d) determining whether to make an award based on the modified selected symbol set; and wherein the removal condition also requires that the designated symbol is within a designated number of display positions from the removable symbol.

2. A method as claimed in claim 1, wherein the source symbol set comprises a plurality of symbol sets at least one of the symbol sets comprising at least one removable symbol and at least one of the symbols sets comprising at least one designated symbol, and the method comprises selecting at least one symbol from each of the plurality of symbol sets, and if a removable symbol is to be removed, removing the at least one removable symbol from at least the symbol set from which it was selected to form a modified plurality of symbol sets constituting the modified source symbol set and selecting at least one symbol from each of the modified plurality of symbol sets to form the modified selected symbol set.

3. A method as claimed in claim 1, wherein the removal condition is solely that the designated symbol is one of the selected symbols.

4. A method as claimed in claim 1, wherein the designated number of display positions are neighbouring display positions.

5. A method as claimed in claim 1, and further comprising determining whether to make an award after step (a).

6. A method as claimed in claim 1, and further comprising repeating steps (b) to (d) at least once.

7. A method as claimed in claim 6, comprising repeating steps (b) to (d) until an end condition is met.

8. A method as claimed in claim 7, wherein the end condition is that steps (b) to (d) are repeated a number (N) of times.

9. A method as claimed in claim 7, wherein the end condition is that a number (M) of removable symbols have been removed.

10. A method as claimed in claim 2, wherein the game is a spinning reel game and each symbol set corresponds to a reel.

11. A method as claimed in claim 10, wherein each designated symbol belongs to at least one reel that has a pair of neighbouring reels.

12. A method as claimed in claim 11, wherein there are five reels and the designated symbols belong to reels two and four.

13. A method as claimed in claim 1, wherein the removable symbols are from a first class of symbols.

14. A method as claimed in claim 13, wherein the first class of symbols are royal symbols.

15. A method as claimed in claim 2, comprising removing all removable symbols of the same type from all of the symbol sets.

16. A method as claimed in claim 2, comprising removing all removable symbols of the same type from the symbol set to which a symbol to be removed belongs.

17. A method as claimed in claim 1, comprising removing a single symbol from the source symbol set.

18. A method as claimed in claim 2, comprising removing no more than one symbol from each symbol set.

19. A method as claimed in claim 1, comprising replacing each removed symbol with a non-removable symbol.

20. A game controller for a gaming system, the game controller arranged to:

a) select a plurality of symbols from a source symbol set to form a selected symbol set for display at a plurality of display positions, the source symbol set comprising at least one removable symbol and at least one designated symbol different to each removable symbol; and in response to a removal condition being met, the removal condition including at least that the selected symbol set includes at least one designated symbol within the display positions;

(b) remove at least one removable symbol from the source symbol set from which it was selected to form a modified source symbol set;

(c) select at least one symbol from the modified source symbol set to form a modified selected symbol set; and (d) determine whether to make an award based on the modified selected symbol set; and wherein the removal condition also requires that the designated symbol is within a designated number of display positions from the removable symbol.

21. A game controller as claimed in claim 20, and further comprising a symbol removal module arranged to remove removable symbols from the symbol sets.

22. A game controller as claimed in claim 21, wherein the symbol removal module determines whether the removal condition is met.

23. A game controller as claimed in claim 20, comprising a symbol selector for selecting symbols.

24. A game controller as claimed in claim 20, comprising a symbol replacer for replacing removed symbols.

25. A game controller as claimed in claim 20, implemented by a processor executing program code stored in a memory.

26. A game controller as claimed in claim 25, wherein the memory stores symbol data specifying the source symbol set, the modified source symbol set, removable symbols and designated symbols.

27. A game controller as claimed in claim 20, wherein the source symbol set comprises a plurality of symbol sets at least one of the symbol sets comprising at least one removable symbol and at least one of the symbols sets comprising at least one designated symbol, and the game controller is arranged to select at least one symbol from each of the plurality of symbol sets, and if a removable symbol is to be removed, remove the at least one removable symbol from at least the symbol set from which it was selected to form a modified plurality of symbol sets constituting the modified source symbol set and select at least one symbol from each of the modified plurality of symbol sets to form the modified selected symbol set.

28. A game controller as claimed in claim 20, wherein the removal condition is solely that the designated symbol is one of the selected symbols.

29. A game controller as claimed claim 20, wherein the designated number of display positions are neighbouring display positions.

30. A game controller as claimed in claim 20, further arranged to determine whether to make an award after the initial selection of symbols from the source symbol set.

31. A game controller as claimed in claim 20, further arranged to, if a removal condition is met in respect of the modified selected symbol set, the removal condition including at least that the selected symbol set includes at least one designated symbol within the display positions;

(b) remove at least one removable symbol from the modified source symbol set from which it was selected to form a further modified source symbol set;

(c) select at least one symbol from the modified source symbol set to form a further modified selected symbol set; and (d) determine whether to make an award based on the further modified selected symbol set.

32. A game controller as claimed in claim 31, arranged to repeatable determine whether each modified symbol set contains a removable symbol until an end condition is met.

33. A game controller as claimed in claim 32, wherein the end condition is that a determination as to whether a removable symbol is in the selected symbol set is carried out a number (N) of times.

34. A game controller as claimed in claim 32, wherein the end condition is that a number (M) of removable symbols have been removed.

35. A game controller as claimed in claim 27, wherein the game is a spinning reel game and each symbol set corresponds to a reel.

36. A game controller as claimed in claim 35, wherein each designated symbol belongs to at least one reel that has a pair of neighbouring reels.

37. A game controller as claimed in claim 36, wherein there are five reels and the designated symbols belong to reels two and four.

38. A game controller as claimed in claim 20, wherein the removable symbols are from a first class of symbols.

39. A game controller as claimed in claim 38, wherein the first class of symbols are royal symbols.

40. A game controller as claimed in claim 27, arranged to remove all removable symbols of the same type from all of the symbol sets.

41. A game controller as claimed in claim 27, arranged to remove all removable symbols of the same type from the symbol set to which a symbol to be removed belongs.

42. A game controller as claimed in claim 20, arranged to remove a single symbol from the source symbol set.

43. A game controller as claimed in claim 27, arranged to remove no more than one symbol from each symbol set.

44. A game controller as claimed in claim 20, further arranged to replace each removed symbol with a non-removable symbol.

45. A gaming system comprising:

a display; and a game controller arranged to:

a) select a plurality of symbols from a source symbol set to form a selected symbol set for display at a plurality of display positions on the display, the source symbol set comprising at least one removable symbol and at least one designated symbol different to each removable symbol; and in response to a removal condition being met, the removal condition including at least that the selected symbol set includes at least one designated symbol within the display positions;

(b) remove at least one removable symbol from the source symbol set from which it was selected to form a modified source symbol set;

(c) select at least one symbol from the modified source symbol set to form a modified selected symbol set; and (d) determine whether to make an award based on the modified selected symbol set; and wherein the removal condition also requires that the designated symbol is within a designated number of display positions from the removable symbol.

46. A gaming system as claimed in claim 45, and further comprising a game play mechanism operable by a player to initiate play of the gaming system.

47. A gaming system as claimed in claim 45, wherein the game controller comprises a symbol removal module arranged to remove removable symbols from the symbol sets.

48. A gaming system as claimed in claim 47, wherein the symbol removal module determines whether the removal condition is met.

49. A gaming system as claimed in claim 45, wherein the game controller comprises a symbol selector for selecting symbols.

50. A gaming system as claimed in claim 45, wherein the game controller comprises a symbol replacer for replacing removed symbols.

51. A gaming system as claimed in claim 45, wherein the game controller is implemented by a processor executing program code stored in a memory.

52. A gaming system as claimed in claim 51, wherein the memory stores symbol data specifying the source symbol set, the modified source symbol set, removable symbols and designated symbols.

53. A gaming system as claimed in claim 45, wherein the source symbol set comprises a plurality of symbol sets at least one of the symbol sets comprising at least one removable symbol and at least one is of the symbols sets comprising at least one designated symbol, and the game controller is arranged to select at least one symbol from each of the plurality of symbol sets, and if a removable symbol is to be removed, remove the at least one removable symbol from at least the symbol set from which it was selected to form a modified plurality of symbol sets constituting the modified source symbol set and select at least one symbol from each of the modified plurality of symbol sets to form the modified selected symbol set.

54. A gaming system as claimed in claim 45, wherein the removal condition is solely that the designated symbol is one of the selected symbols.

55. A gaming system as claimed claim 45, wherein the designated number of display positions are neighbouring display positions.

56. A gaming system as claimed in claim 45, wherein the game controller is further arranged to determine whether to make an award after the initial selection of symbols from the source symbol set.

57. A gaming system as claimed in claim 45, wherein the game controller is further arranged to, if a removal condition is met in respect of the modified selected symbol set, the removal condition including at least that the selected symbol set includes at least one designated symbol within the display positions;

(b) remove at least one removable symbol from the modified source symbol set from which it was selected to form a further modified source symbol set;

(c) select at least one symbol from the modified source symbol set to form a further modified selected symbol set; and (d) determine whether to make an award based on the further modified selected symbol set.

58. A gaming system as claimed in claim 57, arranged to repeatably determine whether each modified symbol set contains a removable symbol until an end condition is met.

59. A gaming system as claimed in claim 58, wherein the end condition is that a determination as to whether a removable symbol is in the selected symbol set is carried out a number (N) of times.

60. A gaining system as claimed in claim 58, wherein the end condition is that a number (M) of removable symbols have been removed.

61. A gaming system as claimed in claim 53, wherein the game is a spinning reel game and each symbol set corresponds to a reel.

62. A gaming system as claimed in claim 61, wherein each designated symbol belongs to at least one reel that has a pair of neighbouring reels.

63. A gaming system as claimed in claim 62, wherein there are five reels and the designated symbols belong to reels two and four.

64. A gaming system as claimed in claim 45, wherein the removable symbols are from a first class of symbols.

65. A gaming system as claimed in claim 64, wherein the first class of symbols are royal symbols.

66. A gaming system as claimed in claim 53, wherein the game controller is arranged to remove all removable symbols of the same type from all of the symbol sets.

67. A gaming system as claimed in claim 53, wherein the game controller is arranged to remove all removable symbols of the same type from the symbol set to which a symbol to be removed belongs.

68. A gaming system as claimed in claim 45, wherein the game controller is arranged to remove a single symbol from the source symbol set.

69. A gaming system as claimed in claim 53, wherein the game controller is arranged to remove no more than one symbol from each symbol set.

70. A gaming system as claimed in claim 45, wherein the game controller is further arranged to replace each removed symbol with a non-removable symbol.

71. A method as claimed in claim 1, and further including a computer program code which when executed implements the method.

72. A method as claimed in claim 71, and further including a non-transitory computer readable medium comprising said program code.

73. A method as claimed in claim 71, and further including a data signal comprising said program code.

74. A method as claimed in claim 71, and further including transmitting said program code.

* * * * *